US009993048B2

(12) United States Patent
Casebolt

(10) Patent No.: US 9,993,048 B2
(45) Date of Patent: Jun. 12, 2018

(54) SAFETY HARNESS CONNECTOR ASSEMBLY

(71) Applicant: D B Industries, LLC, Red Wing, MN (US)

(72) Inventor: Scott C. Casebolt, St. Paul Park, MN (US)

(73) Assignee: D B INDUSTRIES, LLC, Maplewood, MN (US)

( * ) Notice: Subject to any disclaimer, the term of this patent is extended or adjusted under 35 U.S.C. 154(b) by 307 days.

(21) Appl. No.: 14/815,263

(22) Filed: Jul. 31, 2015

(65) Prior Publication Data

US 2016/0360838 A1 Dec. 15, 2016

Related U.S. Application Data

(60) Provisional application No. 62/173,823, filed on Jun. 10, 2015.

(51) Int. Cl.

| | |
|---|---|
| ***A44B 11/25*** | (2006.01) |
| ***A44B 11/06*** | (2006.01) |
| ***A62B 35/00*** | (2006.01) |

(52) U.S. Cl.

CPC ..... *A44B 11/2592* (2013.01); *A44B 11/065* (2013.01); *A44B 11/2584* (2013.01); *A62B 35/0025* (2013.01)

(58) Field of Classification Search

CPC ..... A44B 11/2592; A44B 11/266; A44B 11/2515; A44B 11/2519; A44B 11/2549;

(Continued)

(56) References Cited

U.S. PATENT DOCUMENTS 317,984 A * 5/1885 Essig ..... F16G 7/00 24/33 M 604,302 A 5/1898 Clark (Continued)

FOREIGN PATENT DOCUMENTS

DE 19 27 100 A1 12/1970
DE 3401978 A1 8/1985

(Continued)

OTHER PUBLICATIONS

K. Douskas, Communication Relating to the Results of the Partial International Search, Annex to Form PCT/ISA/206, dated Sep. 7, 2016 (2 pages).

(Continued)

*Primary Examiner* — Jack W Lavinder

(57) ABSTRACT

A safety harness connector is provided, the safety harness connector includes a male buckle system and female buckle system. The male buckle system is configured and arranged to be coupled to at least one first webbing. The male buckle system further includes a male connection portion. The female buckle system is configured and arranged to be coupled to at least one second webbing. The female buckle system includes a female housing member having a receiving chamber to selectively receive the male connection portion of the male buckle system. The receiving chamber has a select receiving chamber depth. The female housing member further has a movement channel portion that is connected to the receiving channel. The movement channel portion has a movement channel depth that is greater than the receiving channel depth. At least a portion of the male connection portion of the male buckle system is positioned within the movement channel portion of the female housing member when the male buckle system is coupled to the female buckle system.

21 Claims, 11 Drawing Sheets

(58) Field of Classification Search
CPC ..... A44B 11/2553; A44B 11/2557; A44B 11/2561; A44B 11/065; A44B 11/2584; A62B 35/0025; A62B 35/0018; A62B 35/0006; A62B 35/00
See application file for complete search history.

(56) References Cited

U.S. PATENT DOCUMENTS

| | | | | |
|---|---|---|---|---|
| 1,209,369 | A | 12/1916 | Wood | |
| 1,459,674 | A | 6/1923 | Jabner | |
| 2,518,889 | A | 8/1950 | Henderson | |
| 2,847,748 | A | 8/1958 | Robinton | |
| 2,903,774 | A | 9/1959 | Harley | |
| 3,090,092 | A | 5/1963 | Szemplak et al. | |
| 3,168,770 | A | 2/1965 | John, Jr. et al. | |
| 3,201,840 | A | 8/1965 | Jantzen | |
| 3,252,188 | A * | 5/1966 | Davis | B65D 63/16 24/68 E |
| 3,424,134 | A | 1/1969 | Rosenblum | |
| 3,513,510 | A | 5/1970 | Copes | |
| 3,530,546 | A | 9/1970 | Ferrando | |
| 3,749,366 | A | 7/1973 | Brucker | |
| 3,757,744 | A | 9/1973 | Pravaz | |
| 3,775,813 | A | 12/1973 | Higuchi | |
| 3,789,467 | A | 2/1974 | Aratani et al. | |
| 3,936,914 | A * | 2/1976 | Mancini | A44B 11/2588 24/684 |
| 3,988,007 | A | 10/1976 | Freiburger, Jr. | |
| 4,091,508 | A | 5/1978 | Yamada et al. | |
| 4,101,171 | A | 7/1978 | Sasaki et al. | |
| 4,264,251 | A | 4/1981 | Blatt | |
| 4,302,049 | A | 11/1981 | Simpson | |
| 4,307,494 | A | 12/1981 | Gasse et al. | |
| 4,321,734 | A | 3/1982 | Gandelman | |
| 4,534,087 | A | 8/1985 | Lau | |
| 4,553,633 | A | 11/1985 | Armstrong et al. | |
| 4,569,106 | A | 2/1986 | Lovato | |
| 4,587,695 | A | 5/1986 | Jensen | |
| 4,604,773 | A | 8/1986 | Weber et al. | |
| 4,656,700 | A | 4/1987 | Tanaka et al. | |
| 4,735,024 | A | 4/1988 | Rosato et al. | |
| 4,779,315 | A | 10/1988 | Kohus | |
| 4,786,223 | A | 11/1988 | Crissy et al. | |
| 4,799,297 | A | 1/1989 | Baggio et al. | |
| 4,893,383 | A | 1/1990 | Quickel | |
| 4,916,779 | A | 4/1990 | Terada et al. | |
| 5,033,171 | A | 7/1991 | Kasai | |
| 5,156,506 | A | 10/1992 | Bailey | |
| 5,203,058 | A | 4/1993 | Krauss | |
| 5,203,829 | A | 4/1993 | Fisk et al. | |
| 5,224,247 | A | 7/1993 | Collier | |
| 5,277,348 | A | 1/1994 | Reid | |
| 5,279,505 | A | 1/1994 | Goudreau et al. | |
| 5,347,693 | A | 9/1994 | Otrusina | |
| 5,355,562 | A | 10/1994 | Matoba et al. | |
| 5,419,020 | A | 5/1995 | Murai | |
| 5,561,891 | A | 10/1996 | Hsieh | |
| 5,564,131 | A | 10/1996 | Anscher | |
| 5,649,341 | A | 7/1997 | Ashline et al. | |
| 5,735,024 | A | 4/1998 | Ortiz | |
| 5,857,247 | A | 1/1999 | Warrick et al. | |
| 5,860,769 | A | 1/1999 | Seligman | |
| 5,926,928 | A | 7/1999 | Lundstedt | |
| 5,974,637 | A | 11/1999 | Tracy et al. | |
| 5,983,463 | A | 11/1999 | Prentkowski et al. | |
| 6,230,370 | B1 | 5/2001 | Nelsen | |
| 6,322,279 | B1 | 11/2001 | Yamamoto et al. | |
| 6,343,824 | B1 | 2/2002 | Foy | |
| 6,357,092 | B1 | 3/2002 | Burrows | |
| 6,405,685 | B1 | 6/2002 | Cox | |
| 6,457,701 | B1 | 10/2002 | Huang | |
| 6,463,640 | B1 | 10/2002 | Toth | |
| 6,484,372 | B2 | 11/2002 | Novak et al. | |
| 6,622,350 | B2 | 9/2003 | Austin et al. | |
| 6,641,116 | B1 | 11/2003 | Huang | |
| 6,668,434 | B2 | 12/2003 | Casebolt et al. | |
| 6,799,750 | B2 | 10/2004 | Chen | |
| 6,824,028 | B2 | 11/2004 | Mutai et al. | |
| 6,824,121 | B2 | 11/2004 | Boice | |
| 6,871,517 | B2 | 3/2005 | Bonelli et al. | |
| 6,965,231 | B1 | 11/2005 | Cinoglu et al. | |
| 7,025,171 | B2 | 4/2006 | Cox | |
| 7,036,628 | B2 | 5/2006 | Wilcox et al. | |
| 7,069,623 | B2 | 7/2006 | Lu | |
| 7,114,225 | B2 | 10/2006 | Casebolt et al. | |
| 7,350,277 | B1 | 4/2008 | Canfield et al. | |
| 7,353,573 | B2 | 4/2008 | Anscher | |
| 7,373,701 | B2 | 5/2008 | Coulombe et al. | |
| 7,513,018 | B2 | 4/2009 | Koenig et al. | |
| 7,628,157 | B2 | 12/2009 | Kosh | |
| 7,712,192 | B2 | 5/2010 | Lin et al. | |
| 8,181,319 | B2 | 5/2012 | Johnson et al. | |
| 8,469,147 | B2 | 6/2013 | Myers et al. | |
| 8,727,073 | B2 | 5/2014 | Lang et al. | |
| 8,967,332 | B2 | 3/2015 | Wolner | |
| 2006/0005293 | A1 | 1/2006 | Frey et al. | |
| 2006/0048350 | A1 | 3/2006 | Coulombe et al. | |
| 2006/0048351 | A1 | 3/2006 | Casebolt et al. | |
| 2006/0081824 | A1 | 4/2006 | Ruan | |
| 2006/0102423 | A1 | 5/2006 | Lang et al. | |
| 2006/0131457 | A1 | 6/2006 | Nohren et al. | |
| 2008/0060873 | A1 | 3/2008 | Lang et al. | |
| 2008/0189921 | A1 | 8/2008 | Tomosue | |
| 2010/0242233 | A1 | 9/2010 | Wolner | |
| 2010/0243373 | A1 | 9/2010 | Johnson et al. | |
| 2011/0017546 | A1 | 1/2011 | Nichols, Jr. | |
| 2011/0099774 | A1 * | 5/2011 | Pontaoe | A45F 3/00 24/457 |
| 2011/0302688 | A1 | 12/2011 | Vieux | |
| 2012/0012623 | A1 | 1/2012 | Bergkvist | |
| 2013/0305493 | A1 | 11/2013 | Hortnagl | |

FOREIGN PATENT DOCUMENTS

| | | |
|---|---|---|
| DE | 20 2004 017 043 U1 | 12/2004 |
| DE | 20 2007 004 649 U1 | 7/2007 |
| GB | 409873 | 5/1934 |
| GB | 2189540 A | 10/1987 |
| WO | WO 02/089626 A2 | 11/2002 |

OTHER PUBLICATIONS

K. Douskas, International Search Report, dated Nov. 7, 2016 (8 pages).
Miller by Honeywell, Miller Revolution Harness, Construction Harnesses and Accessories Brochure, known of prior to filing date (3 pages).
Alpha Vertical, Studbai Brand STU971503 Click Fax Buckle anodised 13kN, [online], [retrieved Nov. 5, 2002], <http://www.alphavertical.co.za/HTML/stubai.html>.
AustriAlpin Stubaital—Paragliding—Buckles. Datasheet [online], Paragliding Buckles Cobra & Click Lock, [retrieved Nov. 5, 2002], <http://www.austrialpin.at/english/flug/k4.php>.
Climbing Technology Limited, Products\Security\Buckles\Fibula Velox, Datasheet [online], [retrieved Dec. 11, 2002], http://www.climbingtechnology.com/product/detail_security.asp?FAMIGLIA=Fibula_Velox . . . >.
DBI SALA, User Instruction Manual Full Body Harness, Form: 5908231, Rev: M. DB Industries, Inc. 2009.
Makefast.com, Datasheet [online], [retrieved Dec. 11, 2002], <http://www.makefast.com/>.
Front assembled view of COBRA buckle (Art.Nr. FC45B) by AustriAlpin Vertriebs GmbH of Tyrol, Austria (2000).
Front disassembeld view of COBRA buckle (Art. Nr. FC45B) by AustriAlpin Vertriebs GmbH of Tyrol, Austria (2000.).
Back disassembeld view of COBRA buckle (Art. Nr. FC45B) by AustriAlpin Vertriebs GmbH of Tyrol, Austria (2000).
Front assembled view of buckle by International Safety Components Ltd. of Wales, U.K. (2000).
Front disassembled view of buckle by International Safety Components Ltd. of Wales, U.K. (2000).

(56) References Cited

OTHER PUBLICATIONS

Back disassembled view of buckle by International Safety Components Ltd. of Wales, U.K. (2000).
Front assembled view of CLICK FIX buckle (Art.Nr. 971501 & 971503) by Stubai GmbH of Tyrol, Austria (2000).
Front disassembled view of CLICK FIX buckle (Art.Nr. 971501 & 971503) by Stubai GmbH of Tyrol, Austria (2000).
Back disassembled view of CLICK FIX buckle (Art.Nr. 971501 & 971503) by Stubai GmbH of Tyrol, Austria (2000).
Front assembled view of Standard Click Lock buckle (Part Nos. 0383 & 0384) by Makefast Limited of Newtown, U.K. (2000).
Front disassembled view of Standard Click Lock buckle (Part Nos. 0383 & 0384) by Makefast Limited of Newtown, U.K. (2000).
Back disassembled view of Standard Click Lock buckle (Part Nos. 0383 & 0384) by Makefast Limited of Newtown, U.K. (2000).
Front assembled view of Fibula Velox buckle (Art. Code L22045) by Climbing Technology Limited of London, U.K. (2000).
Front disassembled view of Fibula Velox buckle (Art. Code L22045) by Climbing Technology Limited of London, U.K. (2000).
Back disassembled view of Fibula Velox buckle (Art. Code L22045) by Climbing Technology Limited of London, U.K. (2000).
SALA "ExoFit XP" Fall Arrest Harness with Rear and Front 'D' Rings & Work Positioning Belt (Model EXH2W-2721), [online], [retrieved on Apr. 16, 2015] Retrieved from the Internet: <http://www.liftingsafety.co.uk/product/exofit-xp-fall-arrest-harness-2721.html>.
Stuba Click Fix nicht verstellbar, [online], [retrieved Nov. 5, 2002], http://www.stubai-bergsport.com/sites/produkte/produkt12/navigatpodukt.htm>.

* cited by examiner

SAFETY HARNESS CONNECTOR ASSEMBLY

CROSS-REFERENCE TO RELATED APPLICATIONS

This application claims priority to U.S. Provisional Application Ser. No. 62/173,823, titled "Safety Harness" herewith, filed on Jun. 10, 2015, which is incorporated in its entirety herein by reference.

BACKGROUND

Various occupations place people in precarious positions at relatively dangerous heights thereby creating a need for fall-arresting or fall protection safety apparatus. Among other things, such apparatus usually includes a safety line interconnected between a support structure and a safety harness donned by a person working in proximity to the support structure. It is important that the safety harness fit properly on the user and that webbing connection joints are designed to aid in the function of the safety harness during a fall event.

For the reasons stated above and for other reasons stated below which will become apparent to those skilled in the art upon reading and understanding the present specification, there is a need in the art for effective safety harness connectors that achieve proper fit for individual users donning the safety harness and is designed to aid in the function of the safety harness during a fall event.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a safety harness connector is provided, the safety harness connector includes a male buckle system and a female buckle system. The male buckle system is configured and arranged to be coupled to at least one first webbing. The male buckle system further includes a male connection portion. The female buckle system is configured and arranged to be coupled to at least one second webbing. The female buckle system includes a female housing member having a receiving chamber to selectively receive the male connection portion of the male buckle system. The receiving chamber has a select receiving chamber depth. The female housing member further has a movement channel portion that is connected to the receiving channel. The movement channel portion has a movement channel depth that is greater than the receiving channel depth. At least a portion of the male connection portion of the male buckle system is positioned within the movement channel portion of the female housing member when the male buckle system is coupled to the female buckle system.

In another embodiment, another safety harness connector assembly is provided. This safety harness connector assembly includes a male buckle system, a female buckle system and pivot mounting member. The male buckle system is configured and arranged to be coupled to at least one first webbing. The male buckle system further includes a male connection portion. The female buckle system is configured and arranged to be coupled to at least one second webbing. The female buckle system includes a female housing member that has a receiving chamber to selectively receive the male connection portion of the male buckle system. The pivot mounting member pivotally couples the female housing member of the female buckle system to the at least one second webbing.

In further still another embodiment, a safety harness connector assembly is provided. This safety harness connector assembly includes a male buckle system and a female buckle system. The male buckle system is configured and arranged to be coupled to a first webbing. The male buckle system includes a male connection portion. The male connection portion terminates in a bent retaining lip. The female buckle system is configured and arranged to be coupled to at least one second webbing. The female buckle system includes a female housing member that has a receiving chamber to selectively receive the male connection portion of the male buckle system and connection cutout section to the receiving chamber. The connection cutout section includes a retaining cutout section that is defined by retaining edges. The bent retaining lip of the male connection portion of the male buckle system is configured and arranged to engage the retaining edges that define the retaining cutout section of the connection cutout section when the male connection portion is received within the receiving chamber of the female buckle system to prevent side rotation of the male buckle system in relation to the female buckle system.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

In one embodiment, a pivoting safety harness connector assembly 100 is provided. The pivoting connection allows the chest strap to be oriented perpendicular to the front straps during normal use, and rotate in line with the front straps in the event of a fall while suspended from a D-ring mounted on the chest strap. In other embodiments the safety harness connector assemblies 100 and 300 include a function that takes up slack in connected webbings or straps of the safety harness or provide more length in the webbing as needed to properly fit the safety harness to the individual user. Further in embodiments, a female housing member of the safety harness connector assemblies 100 and 300 includes a holding movement channel designed to retain a male portion of a male buckle system of the safety harness connector assembly 100 and 300 to prevent unintentional disengagement.

Figure 1:
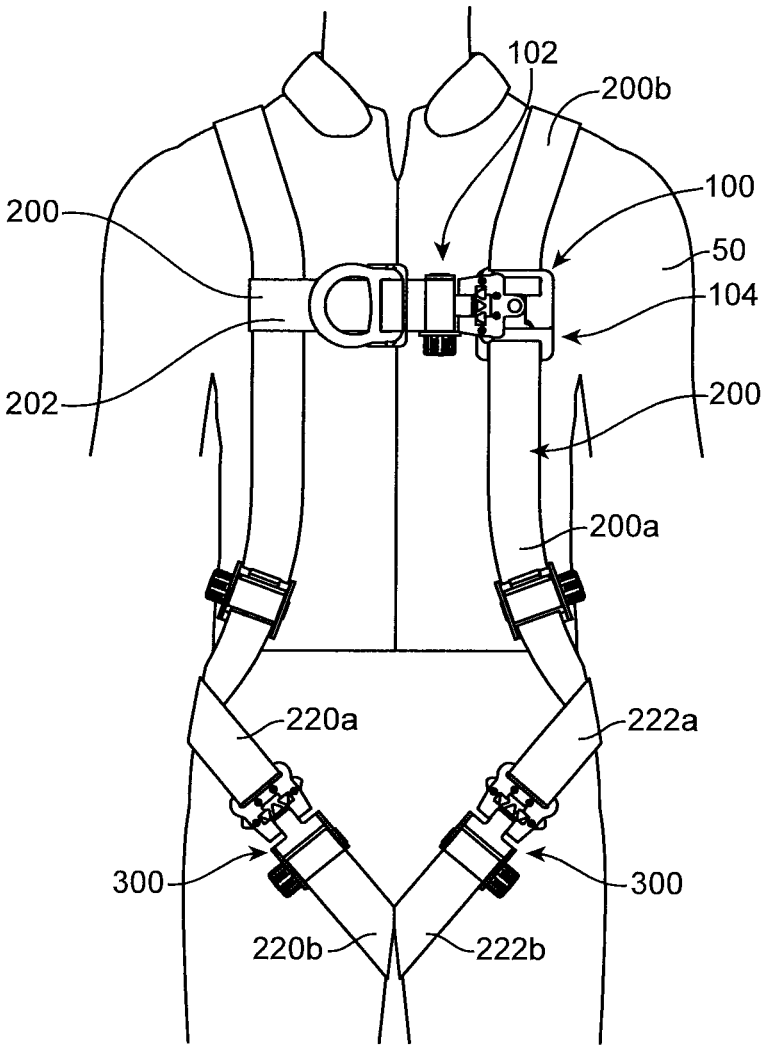
FIG. 1 is a front view of a safety harness donned by a user that includes safety harness connectors of embodiments of the present invention.
Figure 2A:
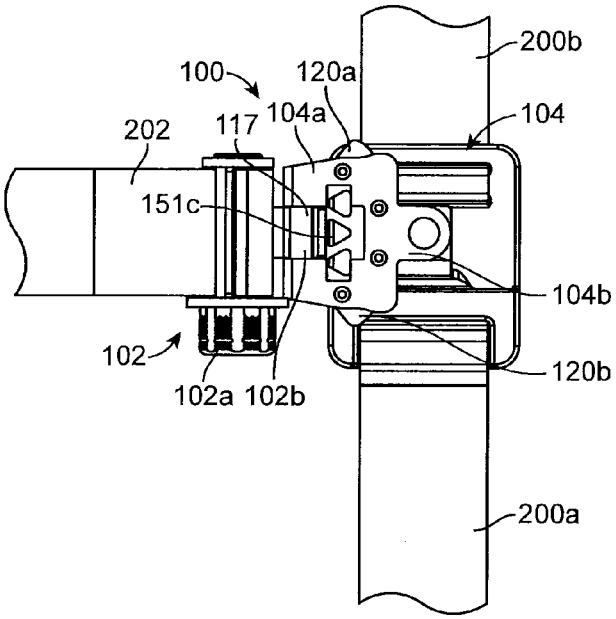
FIG. 2A is a front view of a safety harness connector of an embodiment of the present invention.
Figure 2B:
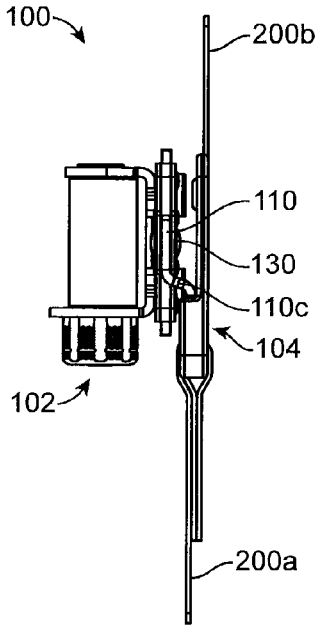
FIG. 2B is a first side view of the safety harness connector of FIG. 2A.
Figure 2C:
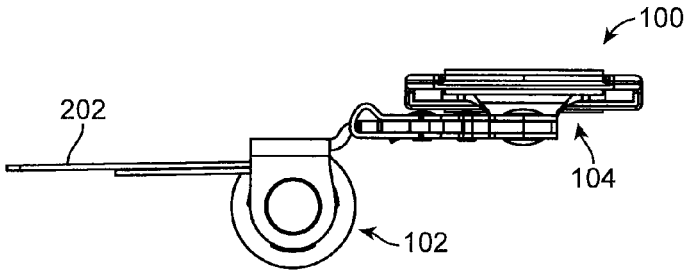
FIG. 2C is a second side view of the safety harness connector of FIG. 2A.
Figure 3A:
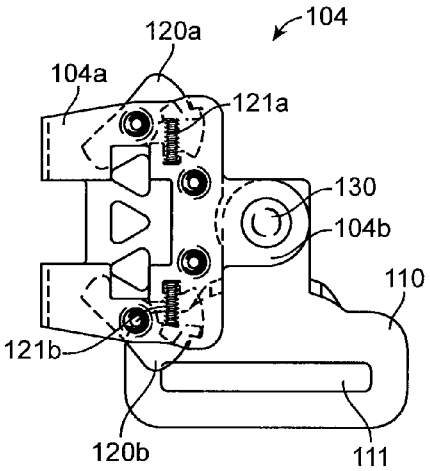
FIG. 3A is a front view of a female buckle system of the safety harness connector of FIG. 2A of one embodiment of the present invention.

An embodiment of a pivoting chest connector assembly 100 of one embodiment coupled to a safety harness 200 donned by a user 50 is illustrated in FIG. 1. The pivoting safety harness connector assembly 100 in this embodiment is pivotally coupled between a chest webbing 202 (chest strap) and a pair of front-shoulder webbings 200*a* and 200*b* (front-straps). The pivoting chest connector assembly 100 includes a male buckle system 102 and a female buckle system 104. The male buckle system 102 in this embodiment includes a revolver portion 102*a* that is designed to roll up any slack in a chest strap 202 or let out additional chest strap 202 when needed for a proper fit. The male buckle system 102 further includes a male connecting portion 102*b* that is designed to be selectively received in a female connecting portion 104*a* of the female buckle system 104. This is illustrated in the close up views of FIGS. 2A-2C and 3A and 3B. The female buckle system 104 further includes a webbing connection portion 104*b*. Within the female connection portion 104*a* a pair of pawls 120*a* and 120*b* are pivotally attached as best illustrated in FIG. 3A. The pawls 120*a* and 102*b* are biased with a pair of pawl biasing members 121*a* and 121*b* to hold the male connecting portion 102*b* of the male buckle system 102 within female connection portion 104*a* of the female buckle system 104 when connected. To release the male connecting portion 102*b* of the male buckle system 102 from the female connection portion 104*a*, the user simultaneously depresses the pawls 120*a* and 120*b* to counter the biasing force provided by the pawl biasing members 121*a* and 121*b*. Once the pawls 120*a* and 120*b* are simultaneously depressed, the male connecting portion 102*b* of the male buckle system 102 can be removed from the female connecting portion 104 of the female buckle system 104.

Figure 4A:
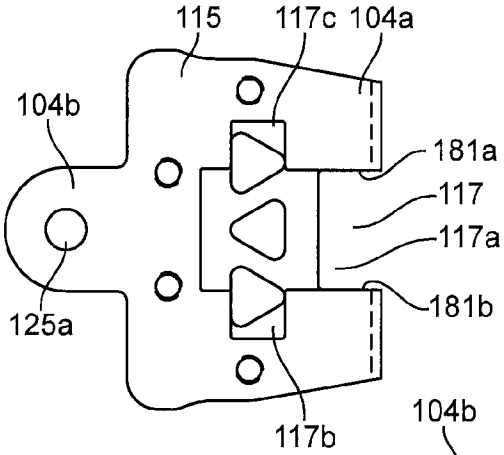
FIG. 4A is a front view of a female housing member of the female buckle system of FIG. 3A of one embodiment of the present invention.
Figure 4B:
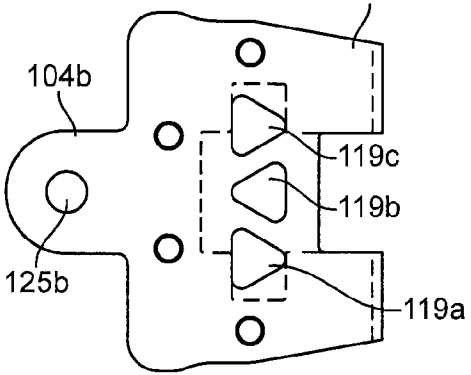
FIG. 4B is a back view of the female housing member of FIG. 4A.
Figure 4C:
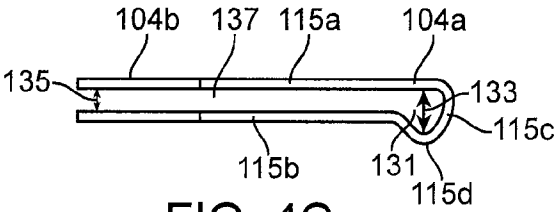
FIG. 4C is a side view of the female housing member of FIG. 4A.

FIGS. 4A through 4C illustrate a female housing member 115 of the female buckle system 104 in one embodiment. The female housing member 115 includes the female connection portion 104*a* and the webbing connection portion 104*b* of the female buckle system 104. As illustrated in the side view of FIG. 4C, in one embodiment the female housing member 115 is generally U-shaped having an upper portion 115*a* (front plate portion), a lower portion 115*b* (back plate portion) and a curved connecting end portion 115*c*. The back plate portion 115*b* is spaced from the front plate portion 115*a* in generally a parallel fashion in this embodiment. The front plate portion 115*a* and the back plate portion 115*b* define a receiving channel 137 that has receiving channel depth 135. The female housing member 115 includes a bump out portion 115*d* that is positioned proximate the curved connecting end portion 115*c* and the back plate portion 115*b*. The bump out portion 115*d* extends out past a plane of the lower portion 115*b* to create a holding movement channel 131 for the male connection portion 102*b* of male buckle system 102 to rotate. The holding movement channel 131 allows the male buckle system to rotate relative to the female buckle system making the connected buckle assembly flexible and adjust to the contours of the user. A holding moment channel depth 133 is greater than the receiving channel depth 135. In the embodiment shown in FIG. 4C the surfaces that make up the holding movement channel 131 are arcuate in shape. Referring to the front view of FIG. 4A, the front plate portion 115*a*, includes a cutout section 117 that is generally in a T-shape having a mid-cutout section 117*a* and opposed side cutout sections 117*b* and 117*c*. The back plate portion 115*b* includes a series of arrow head cutout sections 119*a*, 119*b* and 119*c*. In one embodiment, the arrow head cutout sections 119*a*, 119*b* and 119*c* reduce weight of the buckle.

Figure 3B:
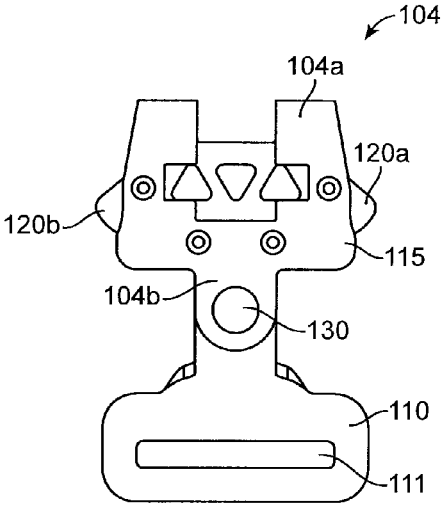
FIG. 3B is a front view of the female buckle system of FIG. 3A in a different orientation.
Figure 5B:
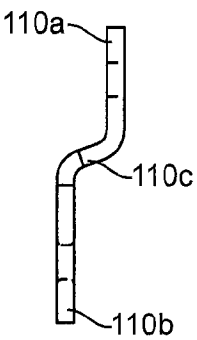
FIG. 5B is a first side view of the pivot mounting member of FIG. 5A.
Figure 5A:
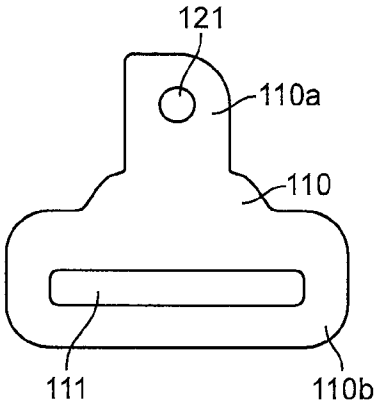
FIG. 5A is a front view of a pivot mounting member of the female buckle system of FIG. 3A of one embodiment of the present invention.
Figure 5C:
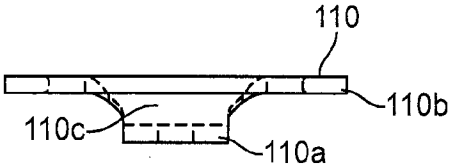
FIG. 5C is a second side view of the pivot mounting member of FIG. 5A.
Figure 6C:
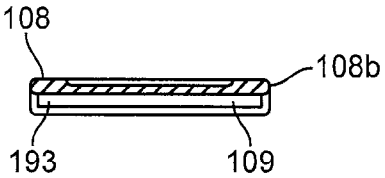
FIG. 6C is a cross-sectional end view of the webbing mount member along line 6C-6C of FIG. 6B.
Figure 6D:
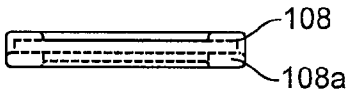
FIG. 6D is an end view of the webbing mount member of FIG. 6A.
Figure 6H:
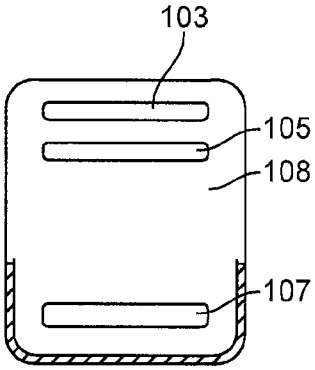
FIG. 6H is a cross-sectional side view of the webbing mount member along line 6H-6H of FIG. 6G.
Figure 6B:
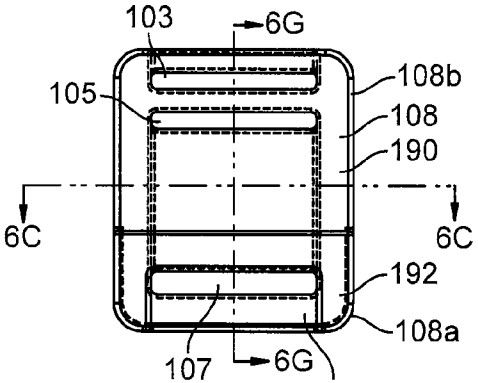
FIG. 6B is a front view of the webbing mount member of FIG. 6A.
Figure 6G:
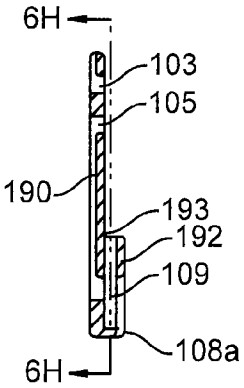
FIG. 6G is a cross-sectional second side view of the webbing mount member along line 6G-6G of FIG. 6B.
Figure 6A:
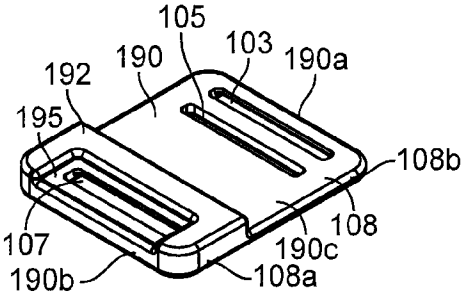
FIG. 6A is a front perspective view of a webbing mount member of the female buckle system of FIG. 3A of one embodiment of the present invention.
Figure 6F:
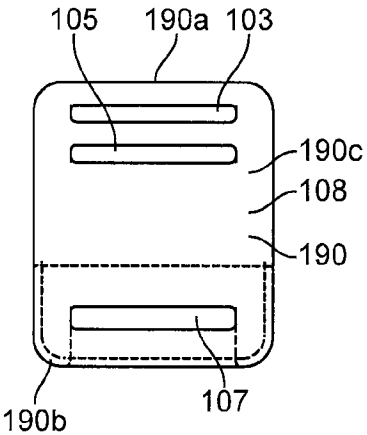
FIG. 6F is a back view of the webbing mount member of FIG. 6A.
Figure 6E:
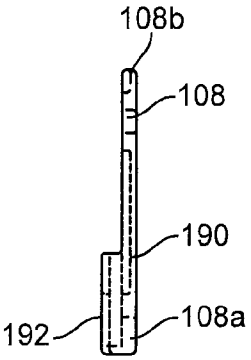
FIG. 6E is a first side view of the webbing mount member of FIG. 6A.

The female buckle system 104 further includes a pivot mounting member 110 as illustrated in FIGS. 5A through 5C. The pivot mounting member 110 includes a pivot connection portion 110*a*, a retaining portion 110*b* and a mid-bend portion 110*c* that connects the connection portion 110*a* to the retaining portion 110*b*. The mid-bend portion 110*c* is generally in a S-shape configuration that places the connection portion 110*a* and the retaining portion 110*b* in different planes that are generally parallel to each other in this embodiment as illustrated in FIG. 5B. Moreover, in this embodiment, the connection portion 110*a* has a width that is less than a width of the retaining portion 110*b* as best illustrated in FIG. 5A. The connection portion 110*a* includes a pivot mounting passage 121 and the retaining portion 110*b* includes a pivot connection member webbing slot 111. The pivot connection member webbing passage 111 has a width that is slightly larger than a width of webbing 200*a*. The female buckle system 104 in this embodiment further includes a shoulder webbing mount member 108 which is illustrated in FIGS. 6A through 6F. The webbing mount member 108 is generally rectangular in shape having a first portion 108*a* that is thicker than a second portion 108*b* which is best illustrated in FIGS. 6A, 6E and 6G. The second portion 108*b* includes a first slot 103 and a second slot 105 that are generally spaced parallel to each other. The first portion 108*a* includes a third slot 107 that is also generally parallel to the first and second slots 103 and 105. In one embodiment, the webbing mount member 108 includes a mount plate 190 having a first end 190*a*, a second end 190*b* and a mid-portion 190*c*. A mount sleeve 192 extends from a surface of the mount plate 190 proximate the second end 190*b* of the mount plate 190 and adjacent to the second portion 108*b* of the webbing mount member 108. The mount sleeve 192 forms a sleeve cavity 109. The mount sleeve 192 includes a sleeve opening 193 to the sleeve cavity 109 that is designed to receive the retaining portion 110*b* of the pivot mounting member 110. The sleeve opening 193 is positioned proximate the mid-portion 190*c* of the mount plate 190. The mount sleeve 192 further includes a sleeve cutout section 195 to the sleeve cavity 109. The sleeve cutout section 193 is positioned proximate the second end 190*b* of the mount plate 190 exposing the third slot 107 in the mount plate 190 of the webbing mount member 108. When the retaining portion 110*b* of the pivot mounting member 110 is within the sleeve cavity 109, the webbing slot 111 of the retaining portion 110*b* of the pivot mounting member 110 is aligned with the third slot 107 of the mount plate 190 such that webbing 200*a* (shown in FIG. 2A) passing through the webbing slot 111 and the third slot 107 couples the pivot mounting member 110 to the webbing mount member 108. Moreover, the webbing 200*a* passing through slot 107 of the shoulder webbing mount plate 190 and slot 111 of the pivot mounting member 110 couples the webbing 200*a* to the female buckle system 104. Shoulder webbing strap 200*b* is routed at least through slots 103 and 105 of the webbing mount member 108 to couple the female buckle system 104 to shoulder strap 200*b* in this example embodiment. Moreover, in one embodiment, the webbings 200*a* and 200*b* are made from one piece of webbing that is routed through the slots 103, 105, 107 and 111 of the respective webbing mount member 108 and pivot mounting member 110. FIG. 2B illustrates the webbing 200*a* and 200*b* coupled to the female buckle system 104. FIG. 2B also illustrates how the mid-bend portion 110*c* of the pivot mounting member 110 spaces the pivot connection point formed via rivet 130 away from the webbing 200*a* and 200*b*. FIGS. 3A and 3B illustrate how the female buckle system pivots. The pivot connection is provided by rivet 130 received within housing pivot passages 125*a* and 125*b* in respective upper portion 115*a* and lower portion 115*b* of the female housing member 115 (illustrated in FIGS. 4A and 4B) and the pivot member passage 121 of the pivot mounting member 110 (illustrated in FIG. 5A). In particular, the pivot connection portion 110*a* of the pivot mounting member 110 is positioned between the upper and lower portions 115*a* and 115*b* of the female housing member 115 such that the housing pivot passages 125*a* and 125*b* of the female housing member 115 are aligned with the pivot mounting passage 121 of the pivot mounting member 110. The rivet 130 is then received in the respective passages 125*a*, 121 and 125*b* to pivotally couple the female housing member 115 to the pivot mounting member 110.

Figure 8B:
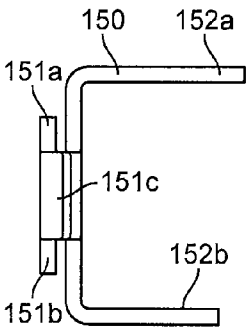
FIG. 8B is a first end view of the base of FIG. 8A.
Figure 8A:
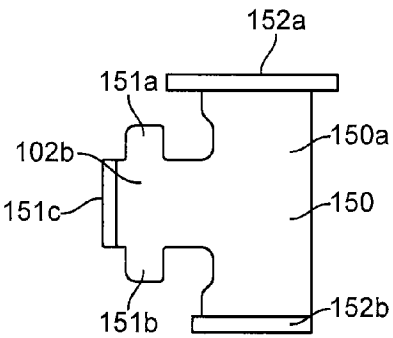
FIG. 8A is a front view of a base of the male buckle system of FIG. 7A of one embodiment of the present invention.
Figure 8D:
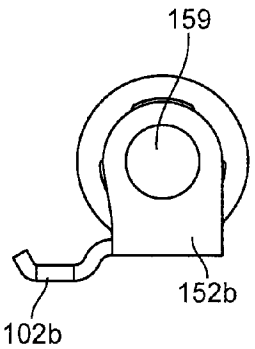
FIG. 8D is a second side view of the base of FIG. 8A.
Figure 8C:
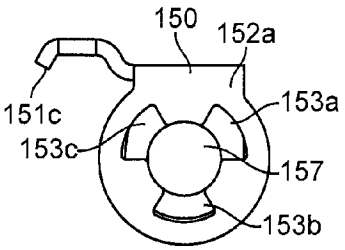
FIG. 8C is a first side view of the base of FIG. 8A.
Figure 7A:
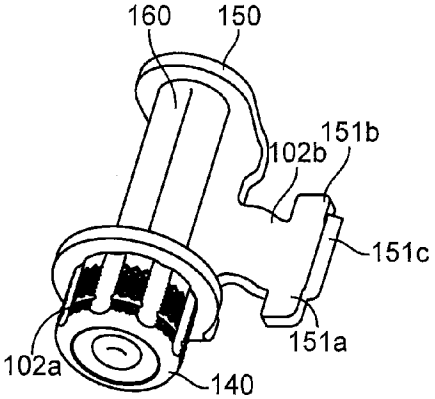
FIG. 7A is a side perspective view of a male buckle system of one embodiment of the present invention.
Figure 7C:
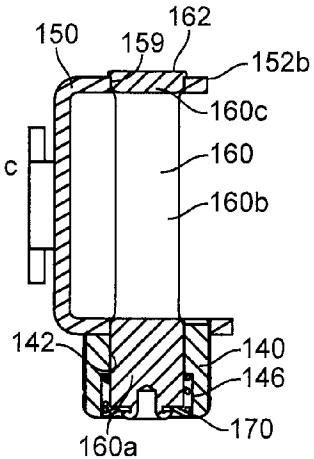
FIG. 7C is a cross-sectional view of the male buckle system along line 7C-7C of FIG. 7B.
Figure 7B:
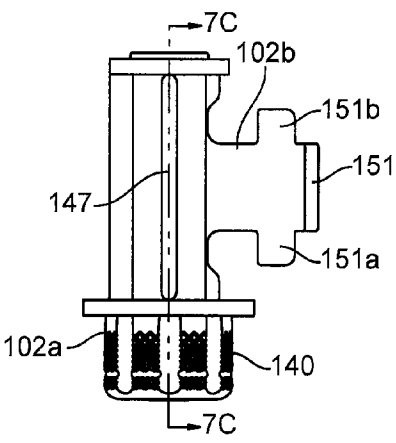
FIG. 7B is a front view of the male buckle system of FIG. 7A.

The male buckle system 102 of an embodiment is illustrated in FIGS. 7A through 7C. The male buckle system 102 includes a base 150 and a knob 140 that is coupled to a shaft 160. The base 150 is illustrated in FIGS. 8A through 8D. The base 150 includes a mid-plate portion 150*a*. Extending generally perpendicular from opposite edges of the mid-plate portion is first and second side walls 152*a* and 152*b*. Further extending from another edge of the mid-plate portion 150*a* is the male connection portion 102*b* of the male buckle system 102. The male connection portion 102*b* is generally T-shaped and is designed to be received in the generally T-shaped cutout section 117 in the front plate portion 115*a* of the female housing member 115. In particular, the male connection portion 102*b* includes holding side tabs 151*a* and 151*b* that are designed to be received in side cutout sections 117*b* and 117*c*. Moreover, in this embodiment, the male connection portion 102*b* terminates in a bent retaining lip 151*c* that is received within the mid-cutout section 117*a* (or retaining cutout section) of the upper portion 115*a* of the female housing member 115 of the female buckle system 104. In particular, the retaining lip 151*c* is bent up from a plane formed by the holding side tabs 151*a* and 151*b* as illustrated in FIG. 8D. The bent retaining lip 151*c* received within the mid-cutout section 117*a* of the upper portion 115*a* of the female housing member 115. Engagement of the bent retaining lip 151*c* with retaining edges 181*a* and 181*b* that define the mid-cutout section 117*a* prevents the male buckle system 102 from side rotation in relation to the female buckle system 104 when the male buckle system 102 is coupled to the female buckle system 104. This prevents the unintentional disconnecting of the male buckle system 102 from the female buckle system 104 in the event one of the pawls 120*a* and 120*b* becomes depressed while the male buckle system 102 and the female buckle system 104 are pushed toward each other. The first side wall 152*a* of the base 150 includes a first shaft aperture 157 as illustrated in FIG. 8C. A plurality of spaced retaining teeth passages 153*a*, 153*b* and 153*c* extended out radially from the first shaft aperture 157. The second side wall 152*b* includes a second shaft aperture 159 as illustrated in FIG. 8D. The second shaft aperture 159 in the second side wall 152*b* is aligned with the first shaft aperture 157 in the first side wall 152*a*.

Figure 12A:
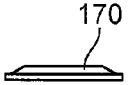
FIG. 12A is a front view of a bias retaining cap of the male buckle system of FIG. 7A of one embodiment of the present invention.
Figure 12B:
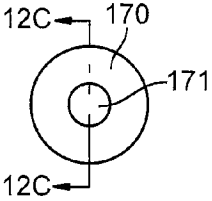
FIG. 12B is an end view of the bias retaining cap of FIG. 12A.
Figure 12C:
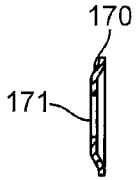
FIG. 12C is a cross-sectional view of the bias retaining cap along line 12C-12C of FIG. 12B.
Figure 11B:
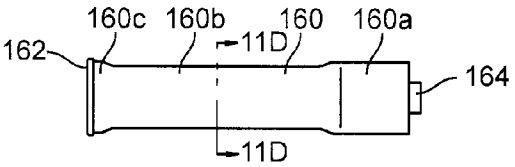
FIG. 11B is a side view of the shaft of FIG. 11A.
Figure 11C:
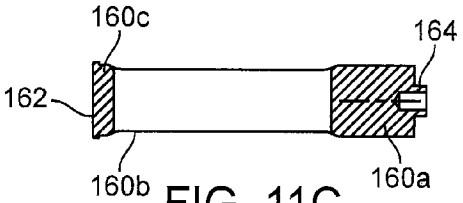
FIG. 11C is a cross-sectional view along line 11C-11C of FIG. 11A.
Figure 11D:
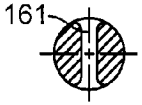
FIG. 11D is a cross-sectional view along line 11D-11D of FIG. 11B.
Figure 11E:
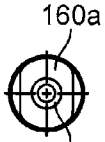
FIG. 11E is an end view of the shaft of FIG. 11A.
Figure 9D:
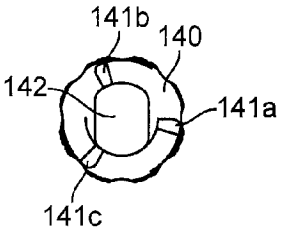
FIG. 9D is a second end view of the knob of FIG. 9A.
Figure 10:
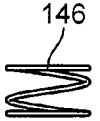
FIG. 10 is a front view of a biasing member of the male buckle system of FIG. 7A of one embodiment of the present application.
Figure 11A:
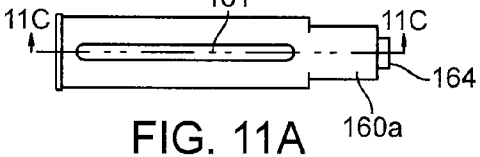
FIG. 11A is a first front view of a shaft of the male buckle system of FIG. 7A of one embodiment of the present invention.
Figure 9A:
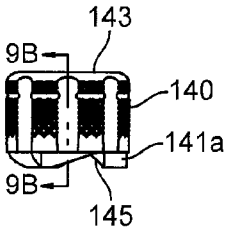
FIG. 9A is a front view of a knob of the male buckle system of FIG. 7A of one embodiment of the present invention.
Figure 9B:
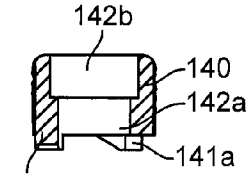
FIG. 9B is a cross-sectional view of the knob along line 9B-9B of FIG. 9A.
Figure 9C:
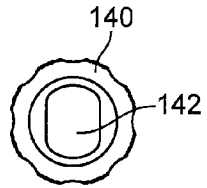
FIG. 9C is a first end view of the knob of FIG. 9A.
Figure 13C:
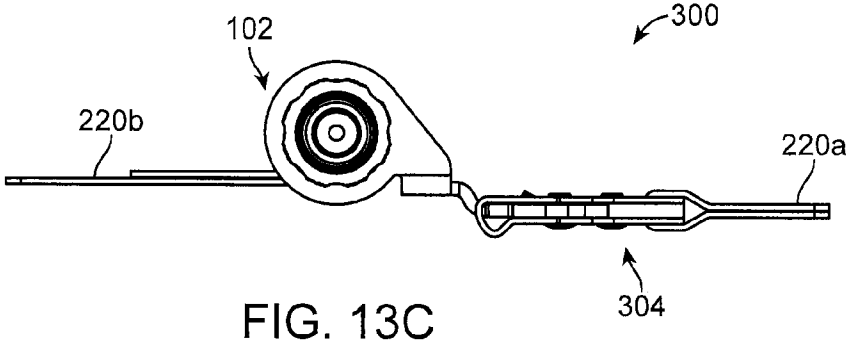
FIG. 13C is a side view of the safety harness connector of FIG. 13A.
Figure 13D:
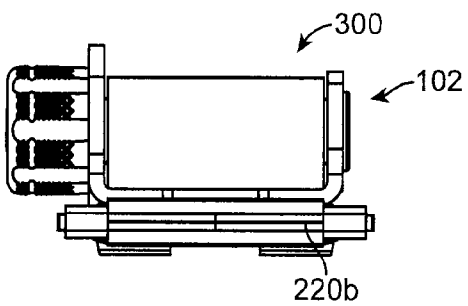
FIG. 13D is an end view of the safety harness connector of FIG. 13A.
Figure 13A:
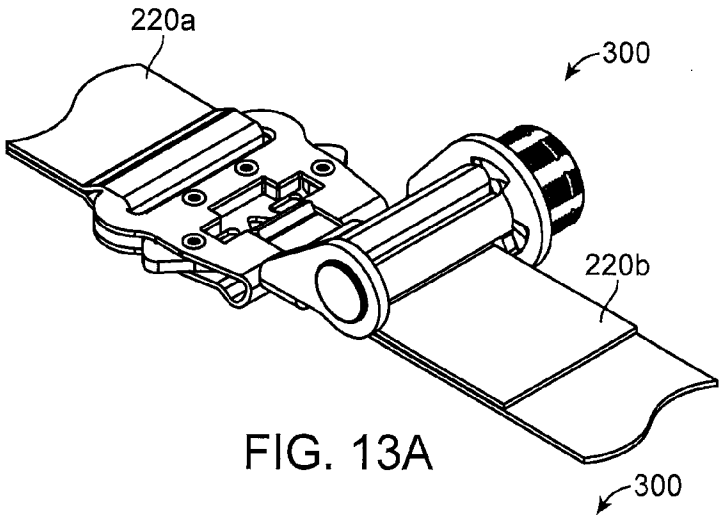
FIG. 13A is a front perspective view of another safety harness connector of an embodiment of the present invention.
Figure 13B:
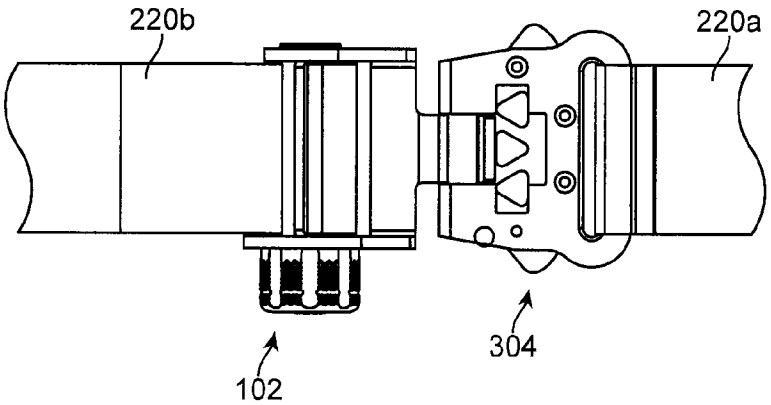
FIG. 13B is a front view of the safety harness connector of FIG. 13A.

The shaft 160 is illustrated in FIGS. 11A through 11E. The shaft 160 includes a first head end 160*a*, a mid-shaft portion 160*b* and a second end 160*c*. The mid-shaft portion 160*b* includes a webbing passage 161. In one embodiment, as illustrated in FIG. 11D, the webbing passage 161 has tapered edges. The head end 160*a* is generally oblong shaped as illustrated in FIG. 11E. A head connection portion 164 extends from the head end 160*a*. An end connector 162 extends from the second end 160*c*. The knob 140 is further illustrated in FIGS. 9A through 9D. The knob 140 has a first end 143 and a second end 145. The knob 140 includes a knob passage 142 that extends from the first end 143 to the second end 145. The passage 142 has a first passage portion 142*a* and a second passage portion 142*b*. The first passage portion 142 has a cross-sectional shape that is oblong and is sized to receive the head end 160*a* of the shaft 160. The second passage portion 142*b* has generally a circular cross-section 142*b*. The first passage portion 142 is positioned proximate the second end 145 of the knob 140 and the second passage 142*b* is positioned proximate the first end 143 of the knob 140. Around a perimeter of the knob passage 142 on the second end 145 of the knob 140 are spaced retaining teeth 141*a*, 141*b* and 141*c*. The retaining teeth 141*a*, 141*b* and 141*c* have a ramped surface side and a retaining edge side. The retaining teeth 141*a*, 141*b* and 141*c* are designed to be selectively received in the retaining teeth passages 153*a*, 153*b* and 153*c* of the first side wall 152*a* of the base 150. A knob biasing member 146, illustrated in FIG. 10, is received in the second passage portion 142*b*. The biasing member 146 is retained in the second passage portion 142*b* of the knob via bias retaining cap 170. The bias retaining cap 170 is illustrated in FIGS. 12A through 12C. The bias retaining cap 170 is generally circular and is designed to be received within the second passage portion 142*b* of the knob 140. The bias retaining cap 170 includes a central passage 171 that is designed to receive the head connection portion 164 of the first head end 160*a* of the shaft 160. Referring to FIG. 7C a further discussion of the configuration is provided. As illustrated, the second end 160*c* of the shaft 160 is received in the second passage 159 of the base 150 while the end connector 162 of the shaft 160 rotationally couples the shaft 160 to the second side wall 152*b* of the base 150. The head end 160*a* of the shaft 160 is received within the first knob passage 157 of the first side wall 152*a* of the base 150 and the knob passage 142 of the knob 140. The biasing member 146 is received around a portion of the head end 160*a* of the shaft 160 and is pointed within the second passage portion 142*b* of the knob passage 142. The bias retaining cap 170 is coupled to the head connection portion 164 of the head end 160*a* of the shaft 160. The biasing member is positioned between the bias retaining cap 170 and a surface in the knob passage 142 that defines the border between the first passage portion 142*a* and the second passage portion 142*b*. In use, when the knob is not being acted on, the biasing member 146 biases the retaining teeth 141*a*, 141*b* and 141*c* of the knob 140 into the retaining teeth passages 153*a*, 153*b* and 153*c* of the first side wall 152*a* of the base 150 to lock a webbing passing though the webbing slot 161 of the male buckle portion in a static position. If the user desires to take up slack in the webbing the user simply rotates the knob in a first direction that winds up the webbing on the mid-shaft portion 160*b* of the shaft 160. The ramp portion of the retaining teeth 141*a*, 141*b* and 141*c* allow the shaft 160 to rotate in the windup direction. If the user desires to loosen the webbing, the user pulls out on the knob 140 countering the bias force of the bias member 146. This allows the retaining teeth 141*a*, 141*b* and 141*c* of the knob 140 to be removed from the retaining teeth passages 153*a*, 153*b* and 153*c* of the first side wall 152*a* of the base 150. While the knob 140 is pulled out, the knob 140 is rotated in a direction to unwind the webbing. Once the knob 140 is released, the bias member 146 asserts the retaining teeth 141*a*, 141*b* and 141*c* of the knob 140 into the retaining teeth passages 153*a*, 153*b* and 153*c* of the first side wall 152*a* of the base 150 to once again lock the webbing in relation to the male buckle system 102.

Another embodiment of the safety harness connector assembly 300 is also illustrated in FIG. 1. This safety harness connector assembly 300 also includes a male buckle system 302 as discussed above and a female buckle system 304. As illustrated in FIG. 1, this embodiment of the safety harness connector assembly 300 is used to respectfully couple lower harness webbings 220*a*, 220*b* and 222*a* and

Figure 14C:
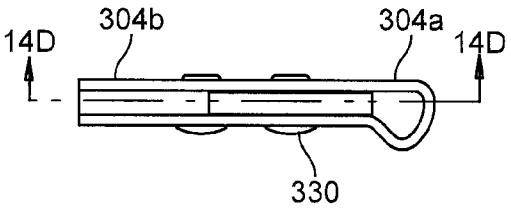
FIG. 14C is a side view of the female buckle system of FIG. 14A.
Figure 14D:
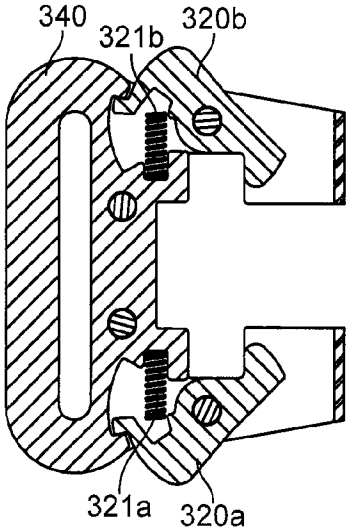
FIG. 14D is a cross-sectional view along line 14D-14D of the of FIG. 14C.
Figure 14B:
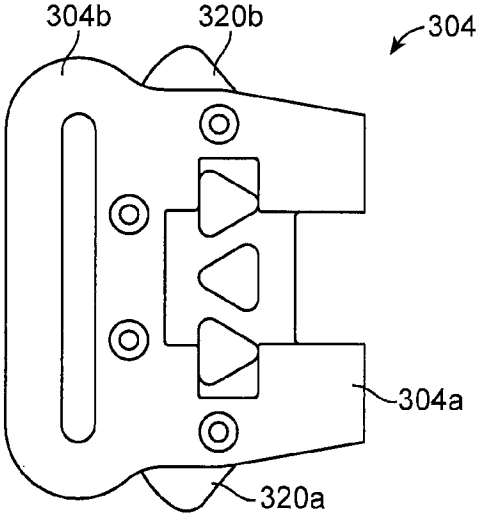
FIG. 14B is a front view of the female buckle system of FIG. 14A.
Figure 14A:
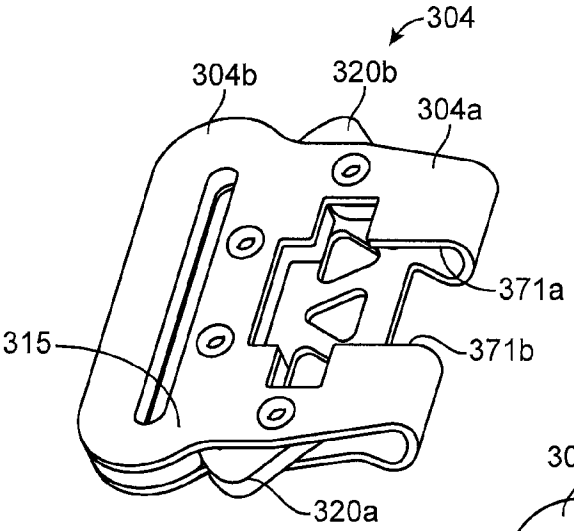
FIG. 14A is a front perspective view of the female buckle system of the safety harness connector of FIG. 13A.

222*b* together. Referring to FIGS. 13A through 13D, close-up views of a safety harness connector 300 coupling webbings 220*a* and 220*b* together is illustrated. FIGS. 14A though 14C illustrates the female buckle system 304. The female buckle system 304 includes a female housing member 315, a mid-plate portion 340, a pair of pawls 320*a* and 320*b* and a pair of pawl biasing members 321*a* and 321*b*. The female housing member 315 is illustrated in FIGS. 15A through 15D. The female housing member 315 includes a female connection portion 304*a* and a webbing connection portion 304*b* of the female buckle system 304. As illustrated in the side view of FIG. 15B, in one embodiment, the female housing member 315 is generally U-shaped having a front plate portion 315*a*, a back plate portion 315*b* and a curved connecting end portion 315*c* similar to the female housing member 115 described above. The back plate portion 315*b* is spaced from the front plate portion 315*a* in generally a parallel fashion creating a receiving chamber 337 of a select chamber depth 339. The female housing member 315 further includes a bump out portion 315*d* that is positioned between the curved connecting end portion 315*c* and the back plate portion 315*b*. The bump out portion 315*d* extends out past the lower portion 315*b* to create a holding movement channel 331 that allows the male connection portion 102*b* of male buckle system 102 to rotate. The holding movement channel 331 has a depth 341 that is greater than the chamber depth 339. Moreover, the surfaces that make up the bump out portion 315*d* are generally arcuate.

Figure 15A:
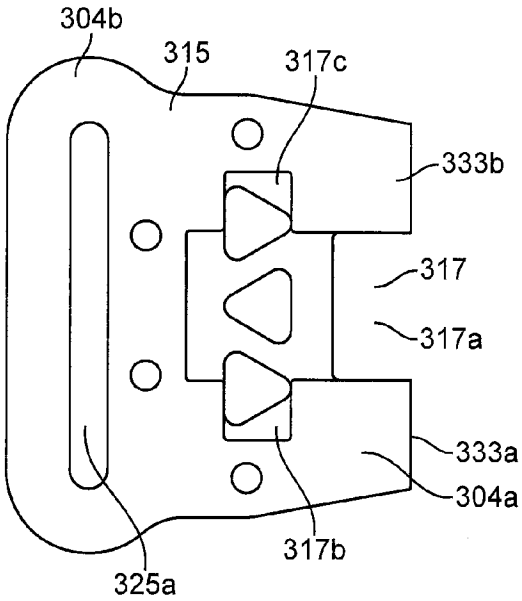
FIG. 15A is a front view of a female housing member of the female buckle system of FIG. 14A.
Figure 15B:
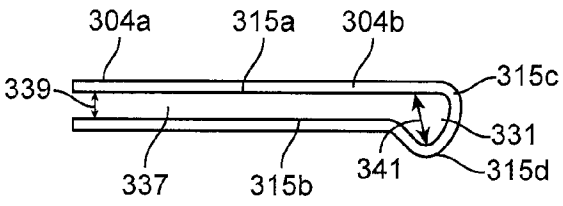
FIG. 15B is a side view of the female housing member of FIG. 15A.
Figure 15C:
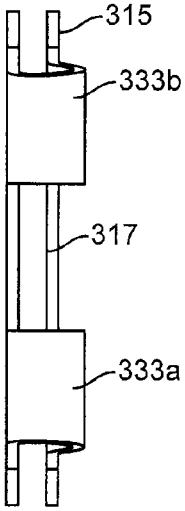
FIG. 15C is an end view of the female housing member of FIG. 15A.
Figure 15D:
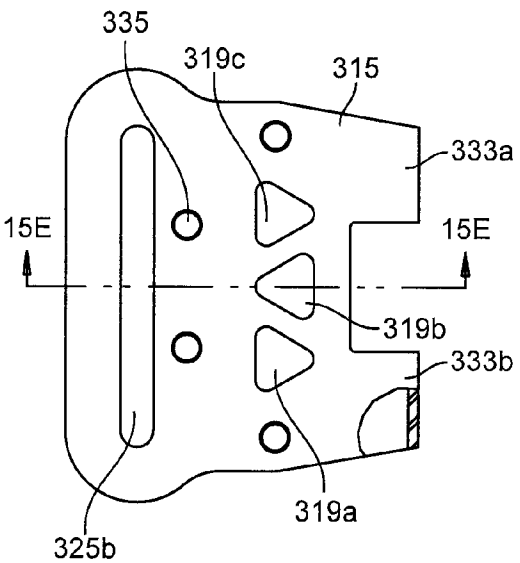
FIG. 15D is a back view of the female housing member of FIG. 15A.
Figure 15E:
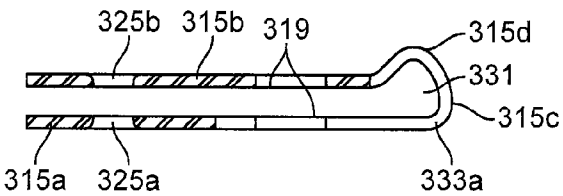
FIG. 15E is a cross-sectional view of the female housing member along line 15E-15E of FIG. 15D.

Referring to the front view of FIG. 15A, the front plate portion 315*a*, includes a cutout section 317 that is generally in a T-shape having a mid-cutout section 317*a* (retaining cutout section) and opposed side cutout sections 317*b* and 317*c*. The mid-cutout section 317*a* forms arms 333*a* and 333*b* of the female connection portion 304*a* that selectively holds the holding side tabs 151*a* and 151*b* of the male connection portion 102*b*. The mid-cutout section 317*a* is defined by retaining edges 371*a* and 371*b* (best illustrated in FIG. 14A). Engagement of the bent retaining lip 151*c* of the male buckle system 102 with the retaining edges 371*a* and 371*b* that define the mid-cutout section 317*a* prevents the male buckle system 102 from side rotation in relation to the female buckle system 304 when the male buckle system 102 is coupled to the female buckle system 304. The front plate portion 315*a* and the back plate portion 315*b* of the female housing member 315 both include aligned webbing slots 325*a* and 325*b* that are used to couple the harness webbing to the female buckle system 304. The back plate portion 315*b* includes a series of arrow head cutout sections 319*a*, 319*b* and 319*c*. The arrow head cutout sections 319*a*, 319*b* and 319*c* are aligned with the side cutout sections 317*b* and 317*c* of the front plate portion 315*a* so they can all be seen from the front view. The arrow head cutout sections 319*a*, 319*b* and 319*c*, in one embodiment, are used to reduce weight of the back plate portion 315*b*.

Figure 17:
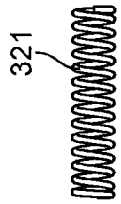
FIG. 17 is a front view of a biasing member of the female buckle system of FIG. 14A.
Figure 18:
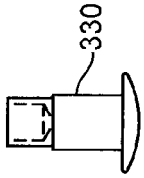
FIG. 18 is a side view of a rivet of the female buckle system of FIG. 14A.
Figure 19:
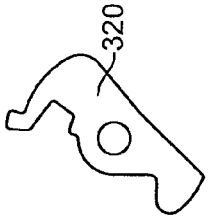
FIG. 19 is a front view of a pawl of the female buckle system of FIG. 14A.
Figure 16C:
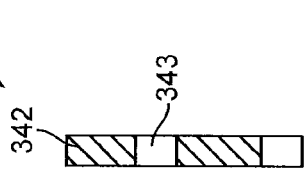
FIG. 16C is a cross-sectional view of the mid-plate portion along line 16C-16C of FIG. 16B.
Figure 16D:
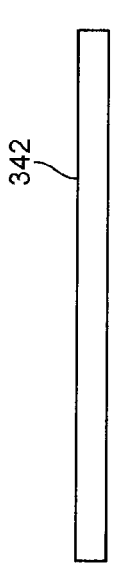
FIG. 16D is an end view of the mid-plate portion of FIG. 16A.
Figure 16A:
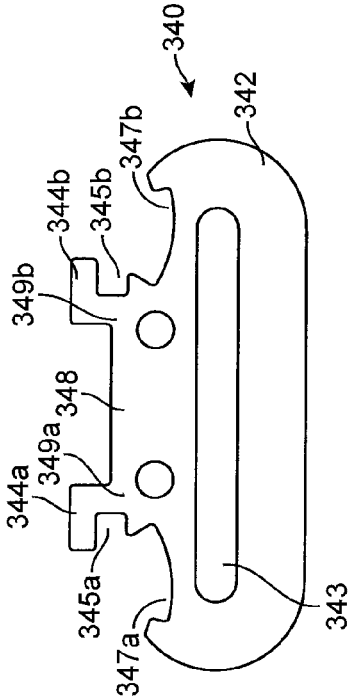
FIG. 16A is a front view of a mid-plate portion of the female buckle system of FIG. 14A.
Figure 16B:
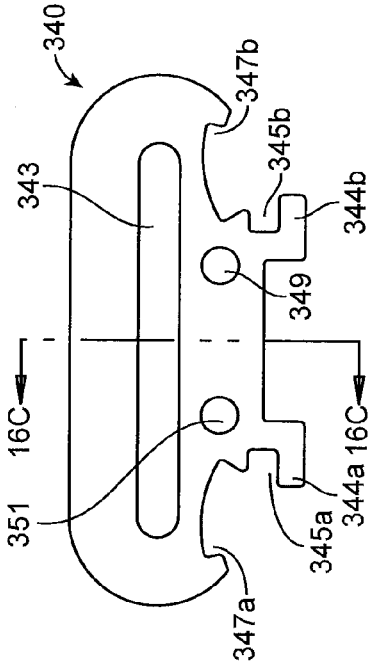
FIG. 16B is a back view of the mid-plate portion of FIG. 16A.

FIGS. 16A through 16D illustrate the mid-plate portion of the female buckle system 304. The mid-plate portion 340 includes a main plate portion 342 that, in this embodiment, has at least a portion that has a similar shape as the webbing connection portion 304*b* of the female housing member 315. The main plate member 342 includes a webbing slot 343 that is aligned with the aligned webbing slots 325*a* and 325*b* of the of the female housing member 315 when the main plate portion 342 is positioned between the front plate portion 315*a* and the back plate portion 315*b* of the female housing member. The mid-plate portion 340 further includes a release control portion 348. The release control portion 348 of the mid-plate portion 340 includes a pair of spaced holding zones 349*a* and 349*b*. The holding zones 349*a* and 349*b* includes shaped edges to hold a respective biasing member (generally referenced as 321) and a pawl (generally referenced as 320). An example pawl biasing member 321 is shown in FIG. 17 and an example of a pawl is illustrated in FIG. 19. The first holding zone 349*a* includes an end foot 344*a* that forms a bias member holding slot 345*a*. Between the bias member holding slot 345*a* and the main plate portion 342 is formed a generally curved pawl guide surface 347*a*. The second holding zone 349*b* includes an end foot 344*b* that forms a bias member holding slot 345*b*. Between the bias member holding slot 345*b* and the main plate portion 342 is formed a generally curved pawl guide surface 347*b*. Referring to FIG. 14D, an illustration of biasing members 321*a* and 321*b* having their respective first ends received within the respective bias member holding slots 345*a* and 345*b* is shown. Also shown in the cross-sectional assembled view of FIG. 14D is a portion of each respective pawl 320*a* and 320*b* received within the respective pawl guide surfaces 347*a* and 347*b*. The first embodiment of the female buckle system 104 includes a similar mid-plate portion 340. Referring to FIG. 18, an example of a rivet 330 that is used to couple the female buckle system 304 together is illustrated. For example, rivets 330 would be positioned in connection apertures 335 of the female housing member 315 and plate connection apertures (shown in FIG. 16B) of the mid-plate portion 340 to couple the mid-plate portion 340 within the female housing member 315.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A safety harness connector assembly comprising:

a male buckle system configured and arranged to be coupled to at least one first webbing, the male buckle system including a male connection portion; and a female buckle system configured and arranged to be coupled to at least one second webbing, the female buckle system including a female housing member having a receiving channel to selectively receive the male connection portion of the male buckle system, the female housing member having a front plate portion, a back plate portion and a curved end portion, the curved end portion extending between the front plate portion and the back plate portion in such a manner that at least part of the front plate portion is positioned a select spaced distance over the back plate portion to define the receiving channel, the female housing portion further including a bump out portion proximate the back plate portion and the curved end portion to form a movement channel portion, at least the front plate portion and the curved end portion including a connection cutout section to the receiving channel, the connection cutout section shaped to receive the male connection portion of the male buckle system to selectively couple the male buckle system of the female buckle system.

2. The safety harness connector assembly of claim 1, further comprising:

the connection cutout section including a mid-cutout section and opposed first and second side cutout sections that form generally a T-shaped connection cutout section; and the male connection portion of the male buckle system being generally T-shaped including first and second holding side tabs configured and arranged to be passed through the respective first and second side cutout sections of the connection cutout sections, at least a portion of the first and second holding side tabs being configured and arranged to be received within the movement channel portion when the male buckle system is coupled to the female buckle system.

3. The safety harness connector assembly of claim 2, further comprising:

at least one pawl pivotally coupled to the female housing member configured and arranged to selectively engage the male connection portion of the male buckle system to lock the male connection portion of the male buckle system within the female housing member of the female buckle system; and at least one pawl biasing member positioned to assert a biasing force on the at least one pawl to engage the male connection portion of the male buckle system.

4. The safety harness connector assembly of claim 2, further comprising:

the male connection portion terminating in a retaining lip configured and arranged to be received within the mid-cutout section of the female housing member.

5. The safety harness connector assembly of claim 1, wherein at least one of the male buckle system and the female buckle system includes a webbing winding system configured and arranged to selectively take up slack in at least one of the first webbing and the at least one second webbing.

6. The safety harness connector assembly of claim 1, wherein the receiving channel has a receiving channel depth, the female housing member further having a movement channel portion that is connected to the receiving channel, the movement channel portion having a movement channel depth that is greater than the receiving channel depth, at least a portion of the male connection portion of the male buckle system positioned within the movement channel portion of the female housing member when the male buckle system is coupled to the female buckle system, the bump out portion extending beyond a plane of the back plate portion to form the movement channel depth being greater than the receiving channel depth.

7. The safety harness connector assembly of claim 6, wherein a surface of the female housing member that forms the movement channel portion is at least partially arcuate in shape.

8. A safety harness connector assembly comprising:

a male buckle system configured and arranged to be coupled to at least one first webbing, the male buckle system including a male connection portion;

a female buckle system configured and arranged to be coupled to at least one second webbing, the female buckle system including a female housing member having a receiving channel to selectively receive the male connection portion of the male buckle system; and a pivot mounting member pivotally coupling the female housing member of the female buckle system to the at least one second webbing, the pivot mounting member having a pivot connection portion, a retaining portion, and a mid-bend portion, the pivot connection portion having a pivot mounting passage, the pivot mounting passage used to pivotally couple the pivot mounting member to the female housing member of the female buckle system, the retaining portion having a webbing slot used to couple the at least one second webbing to the female housing member of the female buckle system, and the mid-bend portion positioned between the pivot connection portion and the retaining portion to distance the female housing member of the female buckle system from the at least one second webbing.

9. The safety harness connector assembly of claim 8, further comprising:

the at least one second webbing includes a second webbing and a third webbing; and a webbing mount member configured and arranged to be coupled to the second webbing and the third webbing, the webbing mount member further configured and arranged to be coupled to the retaining portion to the pivot mounting member.

10. The safety harness connector assembly of claim 9, the webbing mount member further comprising:

a mount plate having a first end, a second end and a mid-portion positioned between the first end and the second end, the mount plate have at least a first webbing slot proximate the first end of the mount plate and a second slot proximate the second end of the mount plate;

a mount sleeve extending from a portion of a surface of the mount plate proximate the second end of the mount plate, the mount sleeve having a sleeve opening to a sleeve cavity configured and arranged to receive the retaining portion of the pivot mounting member, the sleeve opening positioned proximate the mid-portion of the mount plate, the mount sleeve further including a sleeve cutout section to the sleeve cavity, the sleeve cutout section positioned proximate the second end of the mount plate exposing the second slot of the mount plate, wherein when the retaining portion of the pivot mounting member is within the cavity the webbing slot of the retaining portion of the pivot mounting member is aligned with the second slot of the mount plate such that the third webbing passing through the webbing slot and the second slot couples the pivot mounting member to the webbing mount member.

11. The safety harness connector assembly of claim 8, wherein at least one of the male buckle system and the female buckle system includes a webbing winding system configured and arranged to selectively take up slack in at least one of the first webbing and the at least one second webbing.

12. The safety harness connector assembly of claim 8, wherein the receiving channel has a receiving channel depth, the female housing member further having a movement channel portion that is connected to the receiving channel, the movement channel portion having a movement channel depth that is greater than the receiving channel depth, at least a portion of the male connection portion of the male buckle system positioned within the movement channel portion of the female housing member when the male buckle system is coupled to the female buckle system.

13. A safety harness connector assembly comprising:

a male buckle system configured and arranged to be coupled to at least one first webbing, the male buckle system including a male connection portion;

a female buckle system configured and arranged to be coupled to at least one second webbing, the female buckle system including a female housing member having a receiving channel to selectively receive the male connection portion of the male buckle system;

a pivot mounting member pivotally coupling the female housing member of the female buckle system to the at least one second webbing, the female housing member pivoting relative to the pivot mounting member and the at least one second webbing.

14. The safety harness connector assembly of claim 13, further comprising:

the male buckle system including a revolver portion that is configured and arranged to do at least one of taking up slack in the at least one first webbing and extending the length of the at least one first webbing.

15. The safety harness connector assembly of claim 13, wherein the pivot mounting member further includes:

a pivot connection portion having a pivot mounting passage, the pivot mounting passage used to pivotally couple the pivot mounting member to the female housing member of the female buckle system;

a retaining portion having a webbing slot used to couple the at least one second webbing to the female housing member of the female buckle system; and a mid-bend portion positioned between the connection portion and the retaining portion to distance the female housing member of the female buckle system from the at least one second webbing.

16. The safety harness connector assembly of claim 13, further comprising:

the female housing member further having a movement channel portion that is connected to the receiving channel, the movement channel portion having a movement channel depth that is greater than a depth of the receiving channel, at least a portion of the male connection portion of the male buckle system positioned within the movement channel portion of the female housing member when the male buckle system is coupled to the female buckle system.

17. The safety harness connector assembly of claim 16, further comprising:

the female housing member having a front plate portion, a back plate portion and a curved end portion, the curved end portion extending between front plate portion and the back plate portion in such a manner that at least part of the front plate portion is positioned a select spaced distance over the back plate portion to define the receiving channel, the female housing portion further including a bump out portion proximate the back plate portion and the curved end portion to form the movement channel portion, the bump out portion extending beyond a plane of the back plate portion to form the depth of the movement channel portion greater than the receiving channel depth, at least the front plate portion and the curved end portion including a connection cutout section to the receiving channel, the connection cutout section shaped to receive the male connection portion of the male buckle system to selectively couple the male buckle system of the female buckle system.

18. A safety harness connector assembly comprising:

a male buckle system configured and arranged to be coupled to a first webbing, the male buckle system including a male connection portion, the male connection portion terminating in a bent retaining lip; and a female buckle system configured and arranged to be coupled to at least one second webbing, the female buckle system including a female housing member having a receiving channel to selectively receive the male connection portion of the male buckle system and a connection cutout section to the receiving channel, the connection cutout section including a retaining cutout section that is defined by retaining edges, the bent retaining lip of the male connection portion of the male buckle system configured and arranged to engage the retaining edges that define the retaining cutout section of the connection cutout section when the male connection portion is received within the receiving channel of the female buckle system to prevent side rotation of the male buckle system in relation to the female buckle system; and a pivot mounting member pivotally coupling the female housing member of the female buckle system to the at least one second webbing, the pivot mounting member having a pivot connection portion, a retaining portion, and a mid-bend portion, the pivot connection portion having a pivot mounting passage, the pivot mounting passage used to pivotally couple the pivot mounting member to the female housing member of the female buckle system, the retaining portion having a webbing slot used to couple the at least one second webbing to the female housing member of the female buckle system, and the mid-bend portion positioned between the connection portion and the retaining portion to distance the female housing member of the female buckle system from the at least one second webbing.

19. The safety harness connector assembly of claim 18, further comprising:

the receiving channel having a select receiving channel depth, the female housing member further having a movement channel portion that is connected to the receiving channel, the movement channel portion having a movement channel depth that is greater than the receiving channel depth, at least a portion of the male connection portion of the male buckle system positioned within the movement channel portion of the female housing member when the male buckle system is coupled to the female buckle system; and a pivot mounting member pivotally coupling the female housing member of the female buckle system to the at least one second webbing.

20. The safety harness connector assembly of claim 18, further comprising:

the female housing member having a front plate portion, a back plate portion and a curved end portion, the curved end portion extending between the front plate portion and the back plate portion in such a manner that at least part of the front plate portion is positioned a select spaced distance over the back plate portion to define the receiving channel, the female housing portion further including a bump out portion proximate the back plate portion and the curved end portion to form a movement channel portion, the bump out portion extending beyond a plane of the back plate portion to form a movement channel depth being greater than a receiving channel depth, at least the front plate portion and the curved end portion including the connection cutout section to the receiving channel, the connection cutout section shaped to receive the male connection portion of the male buckle system to selectively couple the male buckle system of the female buckle system.

21. The safety harness connector assembly of claim 18, further comprising:

the male buckle system including a revolver portion that is configured and arranged to do at least one of taking up slack in the first webbing and extending the length of the first webbing.

* * * * *